United States Patent [19]

Milner et al.

[11] 4,269,702

[45] May 26, 1981

[54] ORE TREATMENT PROCESS

[75] Inventors: John A. Milner; Roger M. Turner, both of Runcorn, England

[73] Assignee: Imperial Chemical Industries Limited, London, England

[21] Appl. No.: 964,727

[22] Filed: Nov. 29, 1978

[30] Foreign Application Priority Data

Dec. 8, 1977 [GB] United Kingdom ..... 51132/77

[51] Int. Cl.[3] ..... B03D 1/06

[52] U.S. Cl. ..... 209/166; 75/2

[58] Field of Search ..... 75/2, 101 BE; 209/5, 209/9, 166, 167; 252/61; 423/DIG. 14; 260/566 A

[56] References Cited

U.S. PATENT DOCUMENTS

| | | | |
|---|---|---|---|
| 1,449,797 | 3/1923 | Vivian | 209/166 |
| 2,414,199 | 1/1947 | Gutzeit | 75/2 |
| 3,438,494 | 4/1969 | Fuerstenau et al. | 209/166 |
| 4,020,106 | 4/1977 | Ackerley et al. | 423/DIG. 14 |
| 4,130,415 | 12/1978 | Nagaraj et al. | 75/101 BE |

FOREIGN PATENT DOCUMENTS

| | | | |
|---|---|---|---|
| 2355065 | 1/1978 | France | 252/61 |

OTHER PUBLICATIONS

Translation of French Patent Publication 2,355,065.

Clark and Perrin: "Strengths of Organic Bases" pp. 301-303 *Quarterly Reviews* vol. 18 (1964).

Ritcey, G. M., "Solvent-in-pulp Processing using Sieve Plate Pulse Columns" *Chemistry And Industry* pp. 1294-1299 (11/6/71).

DeWitt, C. C. et al., Chelate Compound & Flotation Reagents I; JACS, vol. LXI pp. 1247-1249 (5/1939).

DeWitt, C. C.; et al., Normal Oximes As Flotation Reagents, JACS vol. LXI p. 1250 (5/1939).

*Primary Examiner*—L. Dewayne Rutledge

*Assistant Examiner*—Michael L. Lewis

*Attorney, Agent, or Firm*—Cushman, Darby & Cushman

[57] ABSTRACT

An ore-treatment process for the recovery of metal concentrates from mineral ores containing one or more metals in the form of their sulphides and/or oxides in which the crushed ore is subjected to a froth flotation process in aqueous medium using, as collector, an orthophydroxy phenyl oxime of formula

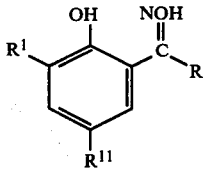

where R is hydrogen or a hydrocarbyl group, $R^1$ is an electron-donating group, especially an alkyl group, and $R^{11}$ is hydrogen or an alkyl, cycloalkyl or aralkyl group. The process is especially suitable for treatment of copper-containing ores.

4 Claims, No Drawings

ORE TREATMENT PROCESS

This invention relates to a process for the recovery of metal concentrates from metal-bearing mineral ores; and to the metal concentrates so obtained.

The recovery of metal concentrates from metal-containing ores is commonly effected by so-called froth flotation processes, by means of which valuable metal compounds, such as metal sulphides and/or oxides may be separated from the gangue materials with which they are associated in the mineral ores.

In a typical froth flotation process, the ore is first crushed and subjected to wet grinding to reduce the size of the ore particles. It is then diluted with water to give a slurry to which various frothing, conditioning and collecting agents are added. The slurry is then aerated to produce air bubbles which rise to the surface as a forth containing a concentration of the desired mineral particles, hereinafter referred to as a metal concentrate.

A number of collecting agents have been proposed; but mercaptans, xanthates and other sulphur containing compounds are commonly used, which tend to be odorous and unpleasant to handle. Xanthates, although effective as collectors for sulphide minerals, have reduced effectiveness for the recovery of oxide or oxidized sulphide minerals. We have now devised a process for the recovery of metal concentrates using sulphur-free collectors, which are applicable to sulphide, oxide and oxidised sulphide ores.

According to the present invention, a process for the recovery of metal concentrates from mineral ores containing a metal or metals in the form of their sulphides and/or oxides, comprises subjecting the crushed ore to a froth flotation process in aqueous medium, using, as collector, an ortho hydroxy phenyl oxime represented by the general formula

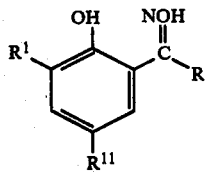

where R represents a hydrogen atom or a hydrocarbyl group, $R^1$ represents an electron-donating group and $R^{11}$ represents hydrogen or an alkyl, cycloalkyl or aralkyl group.

Preferred electron donating groups $R^1$ are alkyl or cycloalkyl groups, for example, those having from 1 to 6 carbon atoms. Hydrocarbyl group R may be aliphatic or aromatic. Examples of groups $R^1$ and $R^{11}$ other than hydrogen include methyl, ethyl, n-propyl, isopropyl, n-butyl, t-butyl and cyclohexyl. Examples of groups $R^{11}$ also include iso-octyl and nonyl. Examples of group R other than hydrogen, include methyl and benzyl.

Without prejudice to the invention, we believe that the nature of groups $R^1$, $R^{11}$ and R affect the relative degree of chemisorption of the oxime compound on the metallic ore and its physical adsorption on the gangue material. The effect may be expressed as "selectivity" with respect to flotation of metal-containing ore in preference to gangue material.

For example, when R is hydrogen and $R^{11}$ nonyl, and there is no electron-donating substituent in the 3 position, the selectivity is very low; but selectivity is enhanced when an alkyl group is present in the 3 position.

Although we believe that $R^1$ gives rise to a predominantly electronic effect, there is a possibility that steric effects are also involved e.g. depending on the size of alkyl group. A further factor in determining the effectiveness of the oxime molecule appears to be the resultant hydrophobicity arising from the inter-relation between groups $R^1$, $R^{11}$ and R. It is of course, necessary to obtain the optimum balance between the two opposing properties to optimise the selectivity of the oxime, bearing in mind the overall requirement that an electron-donating group must be present in the 3 position.

The process of our invention may be applied to mineral ores containing one or more metals, for example, copper, zinc, platinum, molybdenum, nickel, lead, antimony, arsenic, silver and gold. The process is especially suitable for concentrating copper-containing ores.

Generally, the ore to be processed will contain between 0.02 and 1% by weight of the metal or metals to be recovered, but ores containing a higher percentage of metal may be treated. Between 0.001 and 3 g of the oxime may be used for each kg of ore processed, depending on the concentration of metal in the ore and the conditions under which the process is run.

The oxime is generally added, either as solid or an aqueous emulsion, to an aqueous slurry of the ore which has been crushed to give particles in the range of 30–300 μm, preferably 50–150 μm, the slurry containing from 10–40% solids by weight. Alternatively, the oxime may be used as a concentrated solution in an organic solvent, or, if appropriate, one of the other additives.

Normally, metal concentrate recovery processes include several flotation stages, and our oxime collectors may be added to any of these stages. They may also be added at stages prior to or subsequent to those in which other collectors are added. The metal concentrate-containing froth may be skimmed from the surface of the slurry, filtered and the residual concentrate dried.

The metal or metals may be recovered from the metal concentrate by any extraction or refining process, including pyrometallurgical processes. The process of our invention is suitable for the froth flotation of mineral ores containing metal sulphides. Examples of suitable sulphides mineral ores are given in Table I below.

TABLE I

| Metal | Mineral Ore | Empirical Formula |
|---|---|---|
| Copper | Bornite | $Cu_5FeS_4$ |
| | Chalcopyrite | $Cu\ FeS_2$ |
| | Chalcocite | $Cu_2S$ |
| | Covallite | CuS |
| Antimony | Stibnite | $Sb_2S_3$ |
| Cobalt | Cobaltite | CoAsS |
| Lead | Galena | PbS |
| Molybdenum | Molybdenite | $MoS_2$ |
| Nickel | Millerite | NiS |
| Zinc | Sphalerite | Zns |

The process of our invention may also be applied to the froth flotation of mineral ores containing metal oxides. Examples of such ores are given in Table II.

TABLE II

| Metal | Mineral Ore | Empirical Formula |
|---|---|---|
| Copper | Cuprite | $Cu_2O$ |
| | Chrysocolla | $CuSiO_32H_2O$ |
| | Azurite | $Cu_3(CO_3)_2(OH)_2$ |

TABLE II-continued

| Metal | Mineral Ore | Empirical Formula |
|---|---|---|
| | Malachite | $Cu_2CO_3(OH)_2$ |
| Lead | Cerussite | $PbCO_3$ |
| Molybdenum | Wulfenite | $PbMoO_4$ |
| Tin | Cassiterite | $SnO_2$ |
| Zinc | Zincite | ZnO |
| | Smithsonite | $ZnCO_3$ |
| Uranium | Uraninite | $UO_2$ |
| | Pitchblende | $UO_2$ |

For the purpose of this specification, the term "metal oxides" is also intended to cover complex or hydrated oxides, for example carbonates, hydroxides and silicates.

The process may also be used in the froth flotation of mineral ores in which the metals are neither sulphides nor oxides. Examples of such ores are given in Table III.

TABLE III

| Metal | Mineral Ore | Empirical Formula |
|---|---|---|
| Gold | Sylvanite | $(AuAg)Te_2$ |
| | Calaverite | $AuTe_2$ |
| Platinum | Sperrylite | $PtAs_2$ |
| Silver | Hessite | $AgTe_2$ |
| Nickel | Niccolite | NiAs |

It will be appreciated that the pH of the slurry must be controlled to give optimum concentration of the desired metal-containing part of the mineral.

The invention is illustrated by the following Examples.

EXAMPLES 1-3

Flotation Tests in a "Leeds" Cell

A synthetic ore was prepared by dry grinding and sieving, separately, malachite with granite as a gangue material. The fraction of each material between 53 and 150 μm diameter was collected and the two fractions subsequently mixed to give a synthetic ore containing 5.6% copper (referred to as an ore of 5.6% copper grade). The ore so obtained was transferred to a "Leeds Autofloat" three liter laboratory flotation cell and made up to volume. Molar sodium hydroxide solution was added to give a pH of 10.

A solution of the appropriate oxime collector compound dissolved in a minimum of acetone was then added and the resultant slurry conditioned by stirring it for five minutes. At the end of this time an aqueous solution (1 ml of 1% vol/vol) of a polypropylene glycol methyl ether frothing agent was added. The slurry was then floated for several minutes, the froth being continuously removed.

This procedure was continued until the froth became clean. The collected froth was filtered to give a copper concentrate which was analysed to determine its copper content. The characteristics of copper concentrates obtained in this way using various ortho hydroxy phenyl oximes, at a dosage of 1.5 g per kg of ore are shown in Table IV below, in which "Copper %" is the copper content of the concentrate and $$\text{"Recovery \%"} = \frac{\text{quantity of copper in concentrate}}{\text{quantity of copper in synthetic ore}} \times 100$$

TABLE IV

| Ex No | Oxime Collector | Copper Concentrate Copper % | Copper Concentrate Recovery % |
|---|---|---|---|
| 1 | 2-hydroxy,3,5-ditertiary butyl-benzaldoxime | 13.6 | 80.5 |
| 2 | 2-hydroxy,3-methyl,5-tertiary-butyl benzaldoxime | 16.8 | 93.0 |
| 3 | 2-hydroxy,5-methyl,3-tertiary butyl benzaldoxime | 17.9 | 87.6 |
| C1 | 2-hydroxy,5-nonyl benzaldoxime | 7.0 | 25.7 |
| C2 | 2-hydroxy benzaldoxime (salicyaldoxime) | 8.5 | 29.2 |

"C1" and "C2" are comparative tests using analogous oximes having no electron-donating substituent in the 3 position. It is expected that in all these Examples improved grades and recoveries could be obtained by optimising reaction parameters, such as, particle size range, pH, collector concentration and stirrer rate, or by modifying the composition of the reaction mixture, e.g. by the incorporation of commonly used additives, such as gangue depressants.

EXAMPLES 4-6

Flotation tests in a "Wemco" Cell

The "Wemco" cell is a 3 liter laboratory flotation cell. The ore to be tested was jaw-crushed to a particle size of <2 mm. A representative sample (500 g) was then milled in a stainless steel rod mill with water (400 ml) at 106 rpm until the resulting slurry contained mainly particles from 30 to 200 μm diameter. It was then transferred to the glass flotation bowl of the Wemco cell. Water was added to raise the water level to about ½" from the lip of the bowl and stirred to produce a slurry, with the air intake closed. The pH of the slurry was adjusted to 10.5±0.5 by the addition of molar sodium hydroxide solution. The appropriate dosage of collector compound, in methanol, was added to the slurry, followed by 2 ml of a 1% w/v solution of a polypropylene glycol methyl ether to act as a frothing agent. The mixture was conditioned for three minutes, after which time the air intake was adjusted to admit air at the rate of 5-6 liters per minute. The froth forming on the surface of the liquid was manually scraped from the surface into a crystallising dish. Scraping was performed every 10 seconds until no more ore particles were observed in the froth. The air intake was then closed and the duration of the flotation recorded.

The water level was again adjusted to within ½" of the lip of the bowl and further portions of collector compound and frothing agent added. The flotation procedure was carried out as before. Successive flotations were carried out in the same manner, in some cases sodium hydrogen sulphide being added to the slurry, followed by 5 minutes conditioning, before collector and frothing agent were added.

Each fraction was then filtered under suction before drying in air with the aid of infra-red heating. The slurry remaining in the glass bowl (tailings) was filtered and dried similarly. When dry, each sample was weighed and bottled in preparation for subsequent copper analysis. From the weights of samples and their analysis, the average percentage copper in the fractions and the percentage copper recovery were calculated.

EXAMPLES 4 AND 5

A naturally-occurring copper-containing mineral ore (head grade 0.6% Cu) from the Cyprus Pima Mine, USA was crushed, milled and floated in a 3 liter cell, as described above. The collector compound used was the oxime of Example 3. The results of successive floats are set out in Table V below, the final column indicating the cummulative dosage of oxime in each float. It will be appreciated from the results shown under Example 5, that the dosage of oxime may be varied over a wide range.

TABLE V

| Ex No | Accummulative % Cu Recovery | Accummulative % Cu Grade | Cummulative Dosage (Mg/kg)* |
|---|---|---|---|
| | 45 | 8.0 | 10 |
| 4 | 55 | 5.6 | 20 |
| | 62 | 4.4 | 30 |
| | 37 | 8.1 | 1 |
| | 48 | 5.8 | 2 |
| 5 | 54 | 4.5 | 3 |
| | 60 | 3.6 | 4 |

Note
*mg/kg = milligrams of oxime per kilogram of ore.

EXAMPLE 6

A naturally-occurring copper-containing mineral ore (head grade 0.4% Cu) from the Palabora mine, South Africa was crushed, milled and floated as described above. However, in this case potassium amyl xanthate (PAX) was added as collector in the first float and the oxime of Example 1 was added to the second float as a scavenge. The results are set out in Table VI below.

TABLE VI

| Collector Compound | Accummulative % Cu Recovery | Accummulative % Cu Grade | Cummulative Dosage (mg/kg) |
|---|---|---|---|
| PAX | 78.8 | 3.0 | 30 |

TABLE VI-continued

| Collector Compound | Accummulative % Cu Recovery | Accummulative % Cu Grade | Cummulative Dosage (mg/kg) |
|---|---|---|---|
| 2-hydroxy 3,5-di tertiary butyl benzal-doxime | 82.7 | 2.3 | 50 |

EXAMPLE 7

A natural occurring copper-containing mineral ore (head grade 0.5% Cu) from the Utah Island Mine in Canada was crushed, milled and floated as in Example 4. The results are set out in Table VII.

TABLE VII

| Collector Compound | Accummulative % Cu Recovery | Accummulative % Cu Grade | Cummulative Dosage (mg/kg) |
|---|---|---|---|
| 2-hydroxy 5-methyl | 60 | 7.2 | 5 |
| 3-tertiary-butyl benzal-doxime | 80 | 3.7 | 20 |
| | 86 | 2.9 | 50 |

What we claim is:

1. A process for the recovery of metal concentrates from mineral ores containing a metal or metals in the form of their sulphides and/or oxides, in which the crushed ore is subjected to a froth flotation process in aqueous medium using, as collector, an ortho hydroxy phenyl oxime selected from the group consisting of 2-hydroxy, 3,5-ditertiary-butyl benzaldoxime, 2-hydroxy, 3-methyl, 5-tertiary-butyl benzaldoxime and 2-hydroxy, 5-methyl, 3-tertiary-butyl benzaldoxime.

2. A process as claimed in claim 1 in which from 0.001 to 3 g of oxime is added per kg of ore processed.

3. A process as claimed in claim 2 in which a frothing agent is added to the aqueous medium.

4. A process as claimed in claim 2 in which the ore treated is a copper-containing ore.

* * * * *